US007096783B2

(12) United States Patent
Schrauwers

(10) Patent No.: US 7,096,783 B2
(45) Date of Patent: Aug. 29, 2006

(54) PRINTING CYLINDER SUPPORTING UNIT, USE OF PRINTING CYLINDER SUPPORTING UNIT, AND PRINTING MACHINE PROVIDED WITH PRINTING CYLINDER SUPPORTING UNIT

(75) Inventor: Carolus Josephus Antonius Maria Schrauwers, Overloon (NL)

(73) Assignee: Stork Prints B.V., Boxmeer (NL)

( * ) Notice: Subject to any disclaimer, the term of this patent is extended or adjusted under 35 U.S.C. 154(b) by 0 days.

(21) Appl. No.: 10/527,288

(22) PCT Filed: Sep. 9, 2003

(86) PCT No.: PCT/NL03/00627

§ 371 (c)(1),
(2), (4) Date: Mar. 8, 2005

(87) PCT Pub. No.: WO2004/022339

PCT Pub. Date: Mar. 18, 2004

(65) Prior Publication Data

US 2005/0257703 A1 Nov. 24, 2005

(30) Foreign Application Priority Data

Sep. 9, 2002 (NL) ..... 1021417

(51) Int. Cl.
*B41F 5/00* (2006.01)

(52) U.S. Cl. ..... 101/216; 101/212

(58) Field of Classification Search ..... 101/116, 101/271.1, 127.1, 216, 212, 114; B41F 13/44, B41F 15/38

See application file for complete search history.

(56) References Cited

U.S. PATENT DOCUMENTS 3,183,831 A * 5/1965 Zimmer ..... 101/115
3,565,001 A * 2/1971 Zimmer ..... 101/116
3,565,002 A * 2/1971 Boehm ..... 101/116
3,837,277 A * 9/1974 Jaffa et al. ..... 101/127.1
3,892,176 A * 7/1975 Van der Winden ..... 101/116
3,986,451 A * 10/1976 Zimmer ..... 101/127.1
4,056,055 A * 11/1977 Zimmer ..... 101/128.1
4,505,199 A * 3/1985 Hasegawa et al. ..... 101/127.1

(Continued)

FOREIGN PATENT DOCUMENTS

DE 3146255 A1 * 6/1983

(Continued)

*Primary Examiner*—Ren Yan
*Assistant Examiner*—Matthew Marini
(74) *Attorney, Agent, or Firm*—Hoffman & Baron, LLP

(57) ABSTRACT

Printing cylinder supporting unit for a printing machine, with a supporting frame (27) aid supporting means mounted on said supporting frame for rotatably supporting one of several printing cylinders (1), which are designed so that in the operating state they make contact along a contact line (6) with a substrate (3) that is to be printed, which printing cylinders (1) can have different diameters, the supporting means comprising at least three supporting bearings (11.1, 12.1, 13.1), each of which interacts at the position of a bearing point with the hearing surface (5) of a bearing ring fixed concentrically on the printing cylinder (1). The bearing points lie on a common circle with variable diameter. The supporting bearings are movable in such a way that the bearing points move along lines that have a fixed position relative to the supporting frame (27), which lines intersect each other at a fixed reference point lying on the same common circle and in the operating state lying in a plane that is defined by the contact line (6) and the center point of the common circle.

8 Claims, 5 Drawing Sheets

U.S. PATENT DOCUMENTS

| | | | | | |
|---|---|---|---|---|---|
| 4,667,952 | A * | 5/1987 | Jeschke et al. | 271/277 |
| 4,909,142 | A * | 3/1990 | Bubley | 101/115 |
| 5,392,709 | A * | 2/1995 | Seyffert et al. | 101/216 |
| 6,142,072 | A * | 11/2000 | Rudewitz et al. | 101/216 |
| 6,382,092 | B1 * | 5/2002 | Van Den Brink et al. | 101/116 |
| 6,868,779 | B1 * | 3/2005 | Schrauwers | 101/116 |
| 2005/0257703 | A1 * | 11/2005 | Schrauwers | 101/216 |

FOREIGN PATENT DOCUMENTS

| | | | |
|---|---|---|---|
| DE | 3416256 | A1 * | 6/1983 |
| EP | 0 864 421 | A2 | 3/1989 |
| JP | 59096984 | A * | 6/1984 |
| WO | WO 9702144 | A1 * | 1/1997 |

* cited by examiner

PRINTING CYLINDER SUPPORTING UNIT, USE OF PRINTING CYLINDER SUPPORTING UNIT, AND PRINTING MACHINE PROVIDED WITH PRINTING CYLINDER SUPPORTING UNIT

CROSS-REFERENCE TO RELATED APPLICATIONS

This application is the National Stage of International Application No. PCT/2003/000627, filed Sep. 9, 2003, which claims the benefit of Netherlands Application No. NL 1021417, filed Sep. 9, 2002, the contents of which are incorporated by reference herein.

FIELD OF THE INVENTION

The invention relates to a printing cylinder supporting unit for a printing machine, according to the preamble of claim 1.

BACKGROUND OF THE INVENTION

A printing cylinder supporting unit is known from EP-0864421-A1. This publication discloses a printing machine with exchangeable ink application means. Such a printing machine comprises several printing units, in the case of which each printing unit fulfils a separate function in the overall printing process. Such printing units can be suitable for several different types of printing, with different pattern repeat lengths and suitable for various printing techniques such as rotary silk-screen printing, intaglio printing, letterpress printing and flexographic printing. A printing unit generally comprises a printing cylinder and ink application means. In the operating state the printing cylinder makes contact along a describing line on the surface of the cylinder—the contact line—with a substrate that is to be printed. Ink is applied by way of the ink application means to the inside, or directly to the outside, of the printing cylinder.

The printing cylinder rests rotatably in a circumferential bearing system, consisting of three rollers radially enclosing a round bearing ring. Said bearing ring is fixed concentrically on the axial end of the printing cylinder. Such a bearing ring, supported by three rollers, is also situated on the other end of the printing cylinder. One of the three rollers is situated at the position of the contact line. The other two rollers are situated on the other side of the printing cylinder.

In the prior art it is possible to exchange printing cylinders. The reason for changing a printing cylinder may be that a different pattern repeat length has to be printed, and it is advantageous to use a printing cylinder with a different diameter for this purpose. A printing cylinder can also be changed in order to change the printing technique. In order to exchange a printing cylinder, two rollers can move outwards along a track indicated diagrammatically by arrows A in FIG. 11 of the abovementioned patent specification. It is known from practice that such tracks A are produced, for example, by the fact that the rollers are rotatably fixed on swivelling arms, in the case of which the swivel pin of the swivelling arms can, if necessary, undergo a rectilinear translation in its entirety.

This known printing cylinder supporting unit has a major disadvantage. One of the bearing rollers for the radial enclosure is situated in a fixed position, where in the operating state at a reference point it makes contact with the bearing ring. This reference point is situated at a fixed position relative to the contact line. Owing to the position of this fixed roller, printing cylinders having different diameters still make contact with the substrate along the same contact line. The presence of a fixed roller at the position of the reference point proves in practice to be a serious limitation on the usability of the known printing cylinder supporting unit in printing machines in which no account has been taken of this necessary fixed roller, and in which sufficient space is not present for such a fixed bearing roller. The known printing cylinder supporting unit cannot be used in that case. This problem cannot be solved without further ado by placing the fixed bearing roller in a different position, since the contactline would then get a different position related to the reference point, and thus the frame, for each possible diameter of a printing cylinder. This would imply that the substrate to be printed should run along another track related to the frame for each cylinder diameter, which is more complex and thus more experience.

SUMMARY OF THE INVENTION

The object of the present invention is to provide a printing cylinder supporting unit in the case of which these disadvantages are at least partially overcome, or to provide a usable alternative.

In particular, the object of the invention is to provide a printing cylinder supporting unit by means of which printing cylinders of different diameters and/or for different printing methods can be exchanged quickly and easily, and in the case of which it is not necessary for a bearing roller to be situated at the position of the reference point.

This object is achieved according to the invention by a printing cylinder supporting unit according to claim 1. This printing cylinder supporting unit comprises a supporting frame that can support a printing cylinder rotatably at both axial ends of said printing cylinder. To that end, supporting means are fixed on the supporting frame. Said supporting means are arranged in such a way that in the operating state a describing line on the surface of the printing cylinder makes contact with a substrate that is to be printed. This line is also known as the contact line. The supporting means are suitable for receiving printing cylinders with different diameters. The supporting means comprise at least three supporting bearings for each axial end. Said supporting bearings are arranged so that at the position of a bearing point they interact with the bearing surface of a bearing ring fixed concentrically on the end concerned of the printing cylinder, in such a way that the supporting bearings radially enclose the printing cylinder. The printing cylinder supporting unit comprises movement means with which the supporting bearings are movable in such a way that the bearing points move along movement lines, which lines have a fixed orientation relative to the supporting frame. The positions of the supporting bearings are connected to each other by connecting means, such that the bearing points lie on a common circle at all times. This common circle is imaginary, since the device itself does not show this circle. Both the abovementioned movement lines and the common circle intersect each other at a reference point. Said reference point lies at some distance from the contact line and in the operating state lies in a mathematical (imaginary) plane formed by the contact line and the centre point of the common circle. In the operating state the common circle and the bearing surface of the bearing ring coincide with each other. The distance from the reference point to the contact line in the operating state is therefore identical to the shortest distance from the bearing surface of the bearing ring to the surface of the printing cylinder. In the end rings used as bearing rings and in the printing formes used for the present printing techniques this is a constant distance that is not dependent upon the printing forme diameter.

Thanks to the orientation of the movement lines of the bearing points and by connecting the movements of the bearing points, such that the bearing points lie on said common circle with the reference point, printing cylinders with different diameters will still come into contact with the substrate along the same contact line. For this it is not necessary for one of the bearing points to be situated at the position of the reference point, and the disadvantage of the prior art described above has been overcome. The movement lines are advantageously straight lines and the connecting means connect the movements of the bearing points along their respective movment lines in accordance with a fixed ratio. The movement along straight movement lines enables an embodiment, simplifying the connection between the movements, because this occurs in accordance with a fixed ratio. An unexpected advantage is that printing cylinders, irrespective of their diameter, are always supported at approximately the same radial (or angular) position along the circumference of the bearing ring. The optimum angular position $\alpha$, measured around the centre line of the printing cylinder, can be selected for each bearing point and from a reference axis starting in the centre line and pointing away from the contact line.

The direction of the straight movement line along which each bearing point moves, viewed in mathematical terms, follows from the selected angular position a of this bearing point and is equal to $\alpha/2$. The position of each of the bearing points along their line follows from the formula $d \times \cos(\alpha/2)$, in which formula the value d is identical for each of the bearing points and is equal to the value of the diameter of the common circle described by the bearing points with each other at that moment.

In one embodiment the printing cylinder supporting unit comprises straight connecting rods. Said connecting rods connect the supporting bearings to each other. At the position of one of the supporting bearings the straight connecting rods are rigidly connected to each other. Each of the connecting rods extends from this point to one of the other supporting bearings. The connecting rod concerned is connected in a sliding manner to said supporting bearing. At the position of the sliding connection the connecting rods intersect at right angles the line along which the supporting bearings move.

In particular, the supporting bearings move along a straight supporting bearing guide, said supporting bearing guide coinciding with or running parallel to the straight movement line described by the bearing point.

More in particular, the supporting bearing guide is formed, by a groove in the supporting frame, in which a connecting piece is accommodated in a sliding manner. The supporting bearings are fixed on this connecting piece. In combination with the embodiment with straight connecting rods, these connecting rods will be accommodated in a sliding manner by said connecting piece.

In particular, the printing cylinder supporting unit can be designed with three supporting bearings for each axial end of a printing cylinder. In the operating state a first supporting bearing is situated at a position along the bearing ring opposite the contact line and can be moved in the directions away from and towards the contact line. The other two supporting bearings are situated at a radial distance of approximately 120°, measured along the bearing surface of the bearing ring. In order to achieve these positions for the supporting bearings in the case of any diameter of the bearing ring, the bearing points of the second and third supporting bearing must be movable along a line that forms an angle of 60° relative to a mathematical (imaginary) plane formed by the contact line and the centre point of the common circle of the bearing points, which centre point in the operating state lies on the centre line of the printing cylinder. The lines along which the bearing points move are, of course, mirrored relative to the abovementioned mathematical plane.

In a special embodiment the supporting bearings are in the form of rollers, or bearing rollers, which can roll along the bearing surface of the bearing ring of a printing forme mounted in the operating state.

Finally, the invention relates to the use of a printing machine with a printing cylinder supporting unit according to claim 8, and to a printing machine provided with a printing cylinder supporting unit according to claim 9.

BRIEF DESCRIPTION OF THE DRAWINGS

The principle and a preferred embodiment of a preferred embodiment according to the invention will be explained in greater detail with reference to the appended drawings, in which.

DETAILED DESCRIPTION OF PREFERRED EMBODIMENTS

Figure 1:
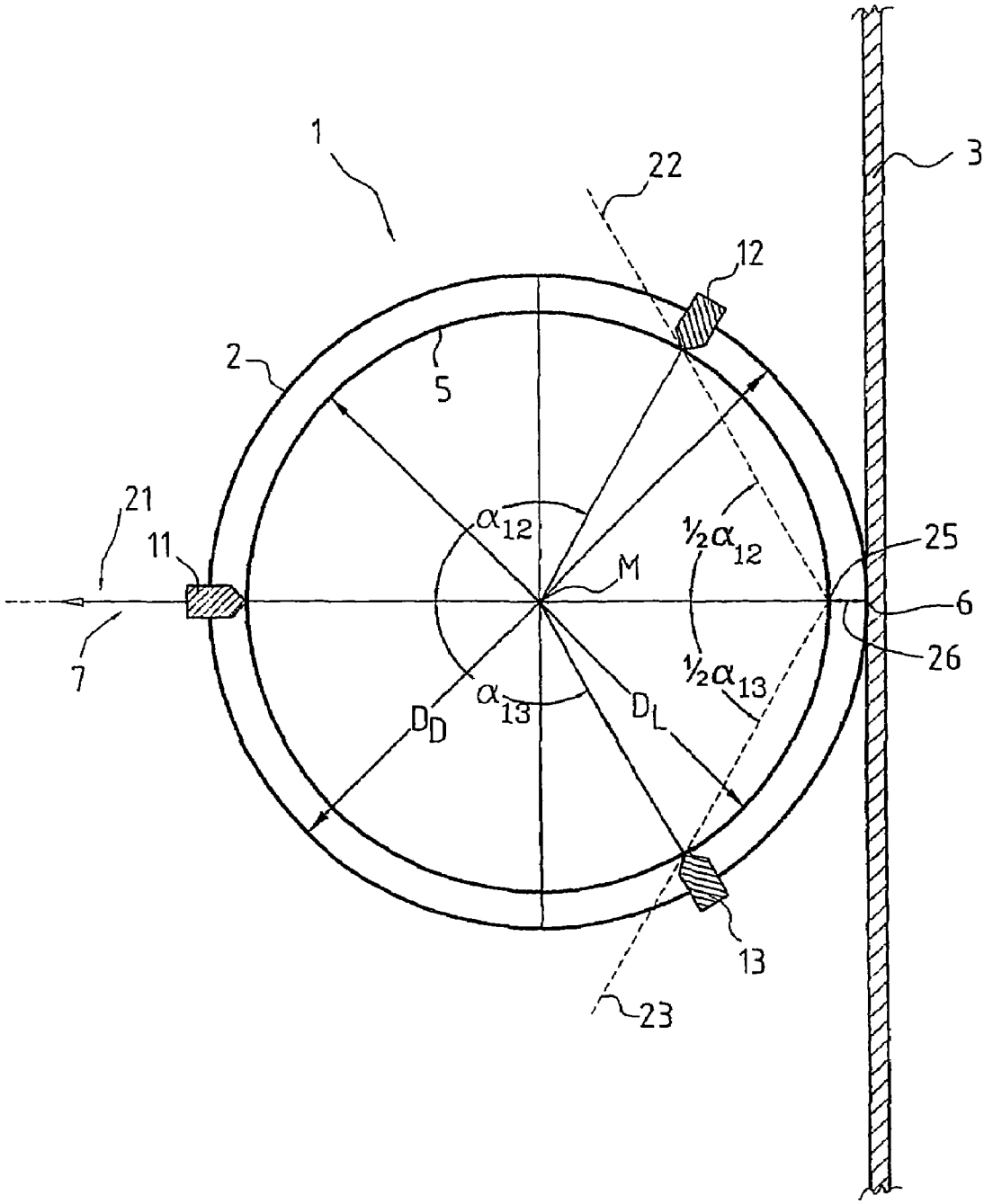
FIG. 1 shows in side view a diagrammatic view of a preferred embodiment according to the invention.

The FIGS. show an exchangeable printing cylinder 1, the surface 2 of which is suitable for the transmission of inking means (not shown) to a substrate 3. In the preferred embodiment the substrate 3 is wedged between the printing cylinder 1 and an impression roller 4. The printing cylinder 1 is provided with a bearing ring, the bearing surface 5 of which is indicated diagrammatically in both FIGS.

During the printing process the substrate 3 is conveyed along the rotating printing cylinder 1. In the process the substrate 3 is in contact with the printing cylinder 1 along a describing line on the surface 2, the contact line 6. The printing cylinder 1 is mounted by way of supporting bearings 11, 12 and 13, which in the preferred embodiment are in the form of rollers 11.1, 12.1 and 13.1. The supporting bearings 11, 12 and 13, or the bearing rollers 11.1, 12.1, 13.1, are in contact with the bearing surface 5 of the bearing ring at a distance that is equal to the radius of the bearing surface of the bearing ring, or half the diameter $D_B$, measured from the centre line M of the printing cylinder. Supporting bearing 12 lies at an angle $\alpha_{12}$ along the bearing surface 5 of the bearing ring. Said angle is defined in a polar coordinates system, in which M is the pole, and the 0-axis is defined by a reference axis 7, which runs from the contact line 6 through the centre M. The positive direction of this reference axis 7, and thus the definition for $\alpha=0$, points away from M of the substrate 3, as shown in FIG. 1 by an arrow point on the end of axis 7. In a comparable manner bearing point 13 lies at an angle $\alpha_{13}$ along the bearing surface 5 of the bearing ring. Bearing point lilies exactly on the reference axis 7, with the result that the angle $\alpha_{11}$ for this bearing point is equal to zero and cannot be shown in the FIG.

When the printing cylinder 1 is to be changed, the supporting bearings move outwards along the dotted lines 21, 22 and 23, the line 21 coinciding with the reference axis 7. The movement lines 21, 22 and 23 intersect each other at a reference point 25 and lie at an angle that is equal to half the $\alpha$ value of the supporting bearings concerned, as shown in the FIG. by $\frac{1}{2}x\alpha_{12}$ and $\frac{1}{2}x\alpha_{13}$. For supporting bearing 11 it again applies that its value of $\alpha$ is equal to zero, and it is therefore not shown in the FIG.

During the insertion of a printing cylinder 1 with an arbitrary cylinder diameter $D_P$ the supporting bearings 11, 12 and 13 move inwards along the lines 21, 22 and 23 until they come into contact with the bearing surface 5 of the bearing ring of the printing cylinder 1 concerned. Thanks to the position and orientation of the lines 21, 22 and 23, the supporting bearings 11, 12 and 13 will always ultimately lie at the same angle a relative to the centre line of the printing cylinder 1, irrespective of the diameters $D_P$ and $D_B$ of the printing cylinder 1 and the bearing surface 5 of the bearing ring. By making sure that in the case of the printing cylinders with different diameter $D_P$ the same difference in diameters is actually kept between the printing surface of the printing cylinder and the bearing surface $D_B$, as is usual in the prior art, it will be ensured that the contact line 6 of the printing cylinder 1 ultimately lies at the same position relative to the supporting frame, and therefore in the operating state always at the same position relative to the substrate 3 and the impression roller 4. In FIG. 1 reference numeral 26 indicates the distance of the bearing surface 5 from the surface 2, the measurement 26 being half the difference between the diameters $D_P$ and $D_B$.

Figure 2:
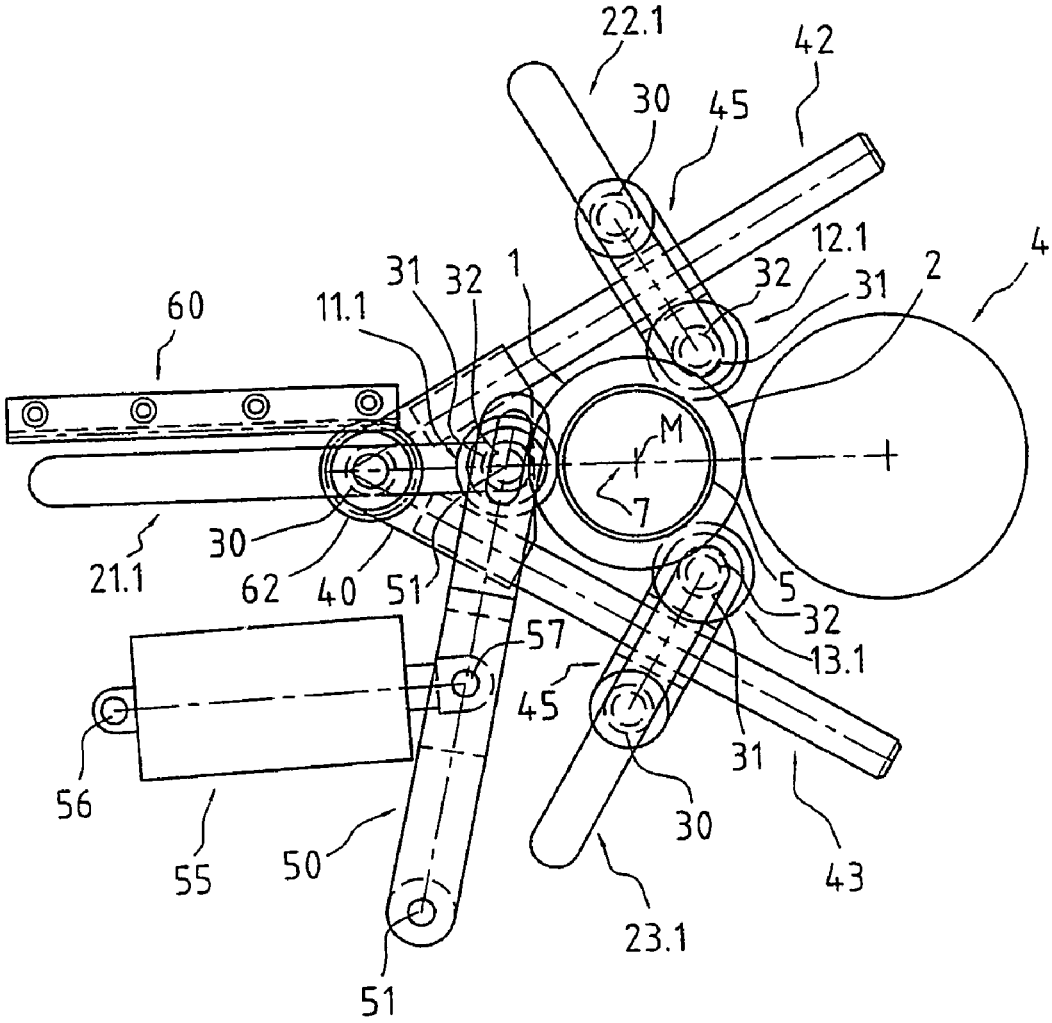
FIG. 2 shows in side view the main parts of a preferred embodiment according to the invention, in the operating state.
Figure 3:
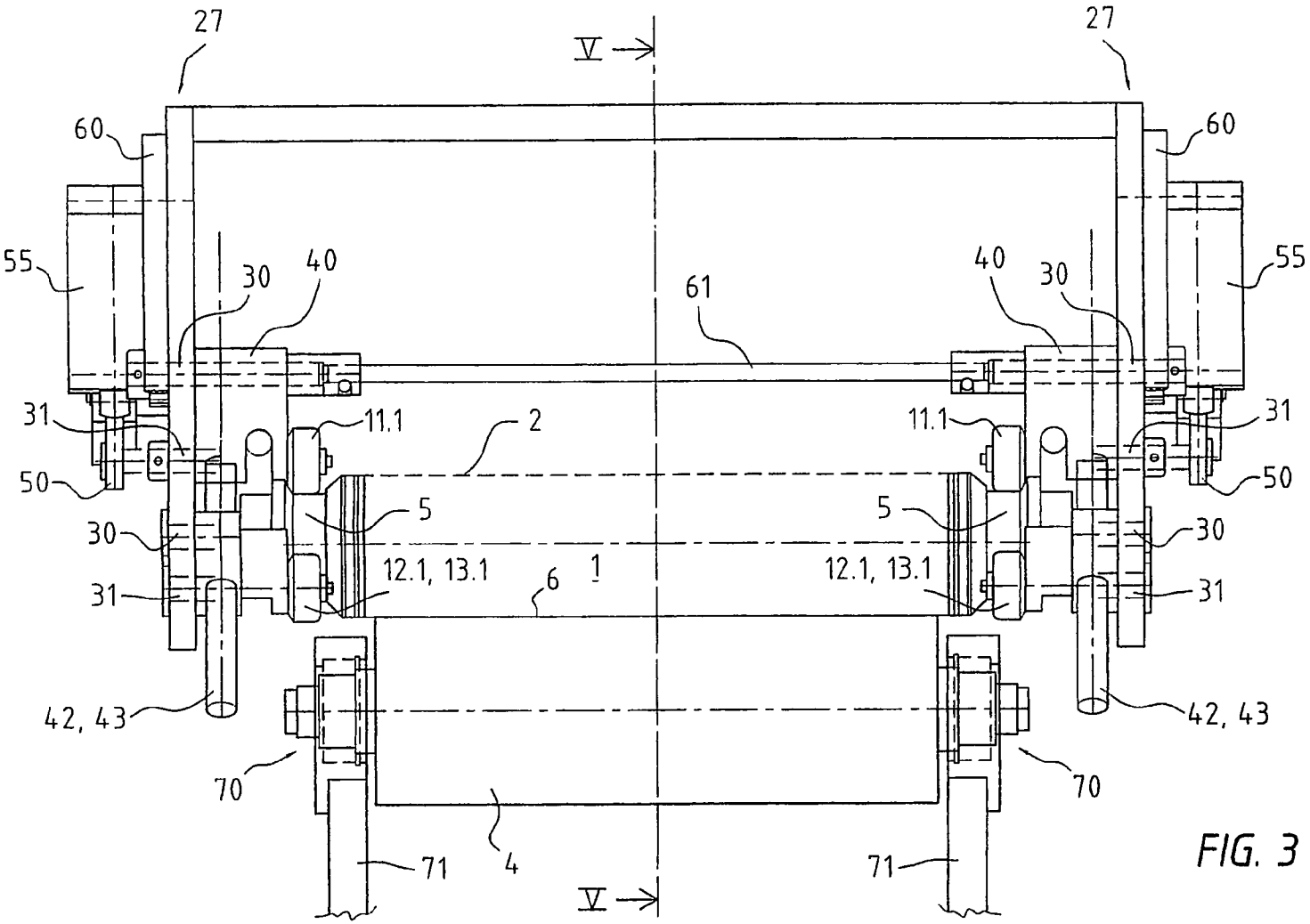
FIG. 3 shows in top view the main parts of a preferred embodiment according to the invention, in the operating state.
Figure 4:
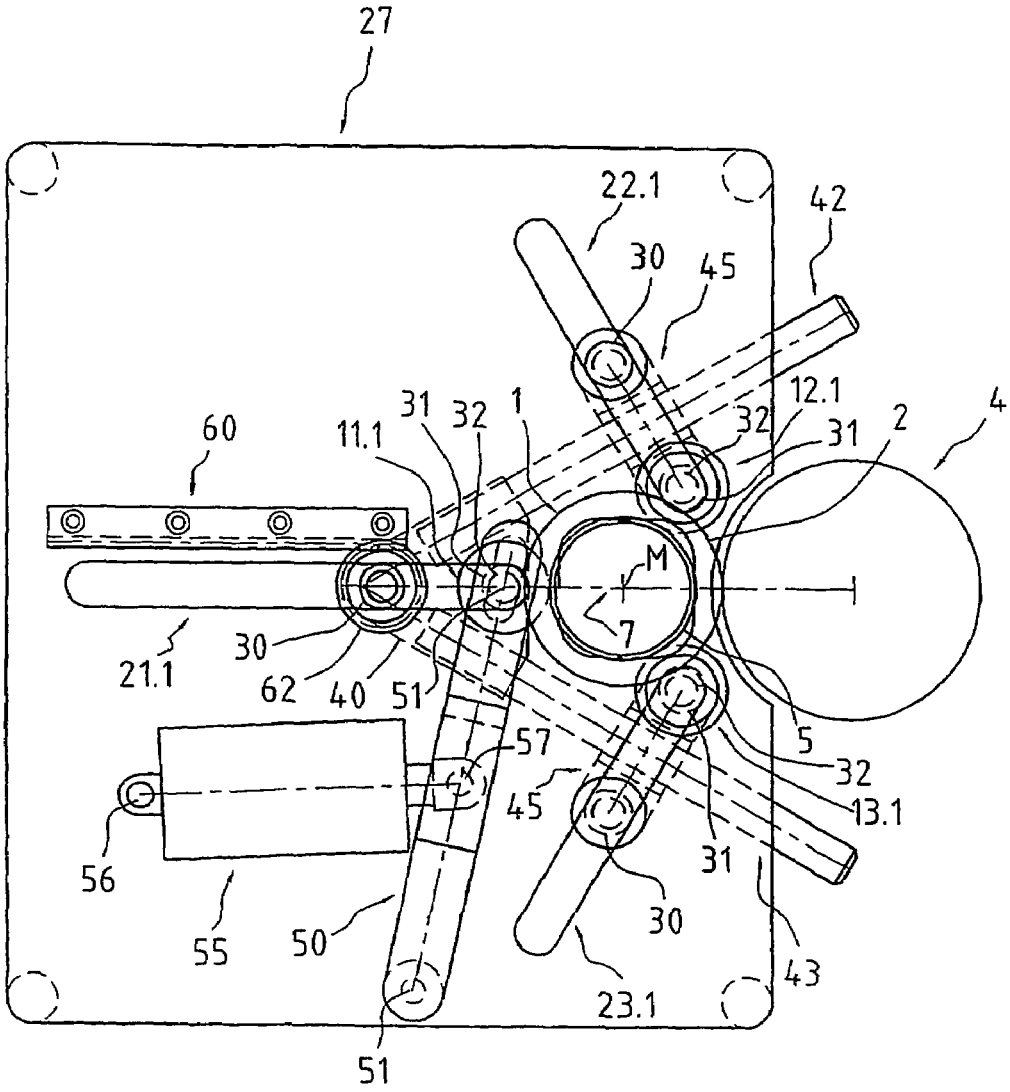
FIG. 4 shows a side view of FIG. 3.
Figure 5:
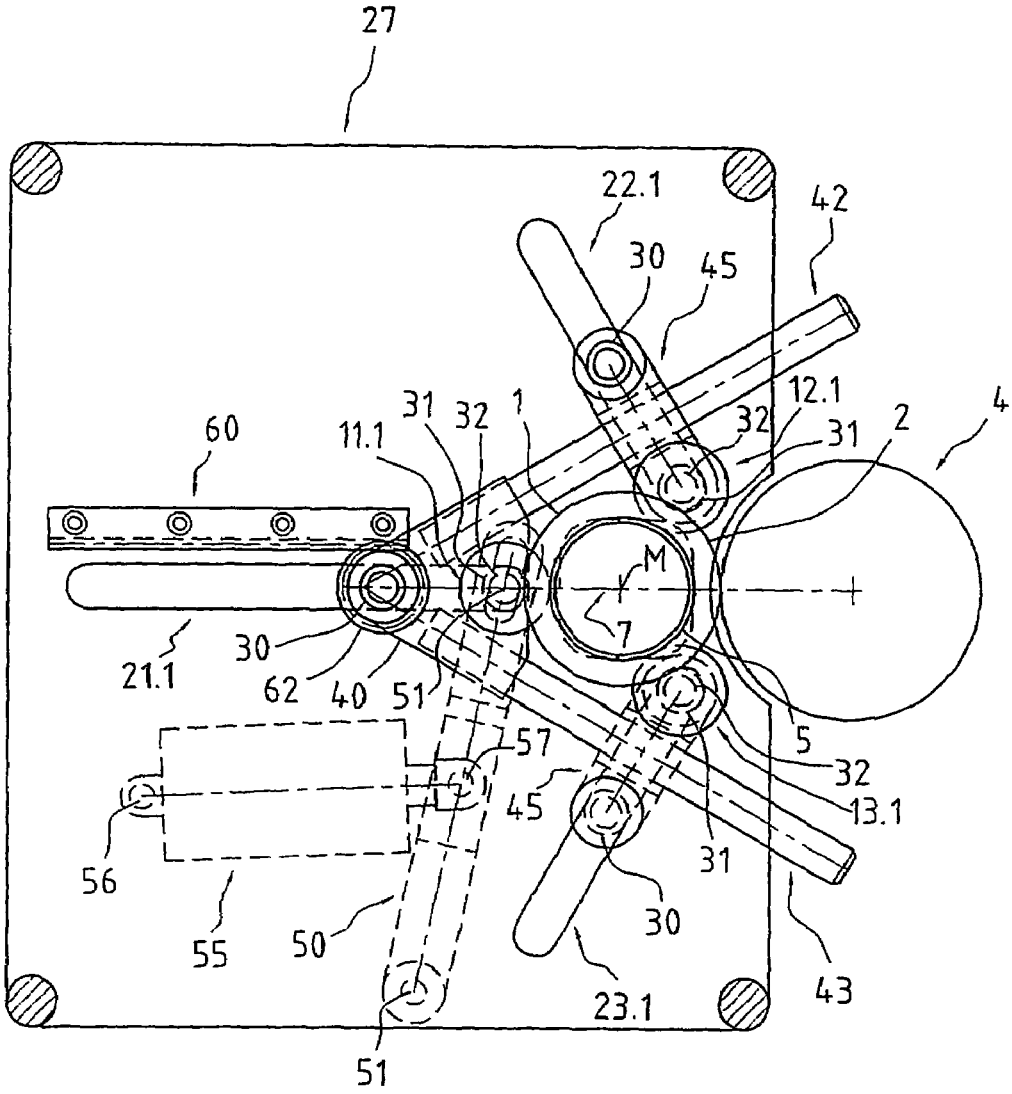
FIG. 5 shows a cross section along V—V of FIG. 3.

In the preferred embodiment shown in FIGS. 2–5 the movement of the bearing rollers 11.1, 12.1 and 13.1 is guided by movement means, comprising straight grooves 21.1, 22.1 and 23.1, which are cut out in the supporting or bearing frame 27, which for the sake of clarity is not shown in FIG. 2. These grooves form an angle of 0°, 60° and −60° respectively with the reference axis 7. This means that the bearing rollers 11.1, 12.1 and 13.1 always come into contact with the bearing surface 5 at positions 0°, 120° and −120° respectively, measured along the circumference of the bearing surface 5. Pins 30 and 31 are accommodated in the grooves 21.1, 22.1 and 23.1, for the purpose of guidance. The pins 31 lie in line with the shafts 32 for the bearing rollers 11.1, 12.1 and 13.1.

At the position of the groove 21.1 the pins 30 and 31 are connected to each other by a substantially triangular plate 40, which plate also forms a rigid connection with rods 42 and 43. Plate 40 and rods 42 and 43 are connecting means for connecting the movements of the bearing points. For this purpose, the rods 42 and 43 are accommodated in a sliding manner between the extension of the pins 30 and 31 at the position of the grooves 22.1 and 23.1 and the connecting pieces 45 between said pins.

A lever 50 is rigidly connected at its one end 51 to the bearing frame 27, while at its other end it is connected in a sliding manner along a point 51 to the triangular plate 40. A pneumatic cylinder 55 is hingedly connected at its one end 56 to the bearing frame 27 and hingedly connected at its other end 57 to the rod 50.

Additional gear racks 60 are provided along the grooves 21.1 for purposes of parallel guidance. This parallel guidance ensures by means of a rod 61 and gearwheels 62, which mesh with the gear racks 61, that the bearing rollers assume the same position at the two axial ends of the printing cylinder. The impression roller 4 is connected by way of an axial bearing 70 to an impression roller frame 71, which for the sake of clarity is shown only in FIG. 3.

FIGS. 2–5 show the operating state in which the printing cylinder 1 is supported by the roller bearings 11.1, 12.1 and 13.1. In order to permit changing of the printing cylinder 1, the pneumatic cylinder 55 will pull the lever 50 to the left, with the result that the bearing roller 11.1 likewise moves to the left. At the same time the rods 42 and 43, which are rigidly connected by means of the triangular plate 40 to the bearing roller 11.1, likewise move to the left. At the position of the grooves 22.1 and 23.1 for the roller bearings 12.1 and 13.1 this movement of the rods 42 and 43 divides into two directions. The first direction lies in the longitudinal axis of the rods 42 and 43 and results in a sliding movement of the rods 42, 43 through between the pins 30 and 31 and the connecting piece 45. The second component of the movement results in a movement in the direction of the grooves 22.1 and 23.1. This component of the movement pushes the pins 30-and by way of the connecting piece 45 likewise the pins 31, the shafts 32 and the bearing rollers 12.1 and 13.1—outwards. As a result of this, the printing cylinder 1 is released and can be removed in a manner known to the person skilled in the art.

After the insertion of a new printing cylinder 1, possibly with a different diameter $D_P$, the pneumatic cylinder 55 by way of the lever 50 moves the bearing roller 11.1 back against the bearing surface 5 of the bearing ring of the printing cylinder 1, so that in a comparable manner to that of opening, the bearing rollers 12.1 and 13.1 are likewise pressed by way of the rods 42 and 43 against the bearing surface 5.

Many embodiments and variants are possible apart from the preferred embodiment shown and described above. For instance, the pneumatic cylinder 55 can be replaced by a drive such as, for example, a spindle, by means of which greater forces can be exerted.

The connection between the movements of the supporting bearings can also be designed in various other ways. For instance in the case of straight guides, the connecting rods and grooves can be provided with gear racks, in which case the sliding transmission is replaced or supported by a gearwheel transmission. The connecting rods can also be replaced by a different form of transmission, such as a transmission consisting entirely of gearwheels, a transmission by means of chains, or an electronic connection in the case of which the movement of the supporting bearings is achieved by means of, for example, a stepping motor. In the case of such alternative types of transmission in combination with the straight guides, the transmission ratios of the movements along the guides must be ensured. In mathematical terms these ratios follow from the formula $d \times \cos(\alpha/2)$, in which the value $\alpha$ is different for each guide and corresponds to the angular position of the supporting bearing point concerned relative to the centre point of the common circle passing through all bearing points. The value d is a variable that always has the same value for the formulae for all guides at a given moment. The value for d is equal to the diameter of the bearing surface of the bearing ring at the moment when the bearing points are resting against said bearing surface. The value for d is greater than this diameter during the opening of the circumferential bearing system.

Finally, the movement lines can be other, like curved. For example, this is the case with the application of swivelling arms as movement means. For such non-straight movement lines, the values $\alpha$ in the above formula are no longer constant and possible mechanical connecting means will get a more complex shape to ensure that the bearing points lie on a common circle. Stepping motors with mutual electronic connection are an alternative for these.

What is claimed is:

1. Printing cylinder supporting unit for a printing machine, comprising a supporting frame and supporting means mounted on the supporting frame for rotatably supporting one of a number of printing cylinders, which are designed so that in the operating state they make contact with a substrate that is to be printed along a contact line coinciding with a describing line of the printing cylinder, wherein the printing cylinders can have different diameters and the supporting means for an axial end of said printing cylinder comprises at least three supporting bearings, each of which is designed to interact at a position of a bearing point with a bearing surface of a bearing ring fixed concentrically on the axial end concerned of the printing cylinder, wherein the bearing points for the axial end concerned of the printing cylinder lie on a common circle with variable diameter;

the printing cylinder supporting unit comprises movement means for moving the supporting bearings in such a way that the bearing points move along movement lines that have a fixed position relative to the supporting frame, the movement lines intersecting each other at a reference point that is fixed relative to the supporting frame, which reference point lies on the same common circle and in the operating state lies in a plane that is defined by the contact line and the centre point of the common circle;

and the printing cylinder supporting unit comprises connecting means for connecting the movements of the bearing points along their respective movement line.

2. Printing cylinder supporting unit according to claim 1, in which the movement lines are straight lines and the connecting means connect the movements of the bearing points along their respective movement line in accordance with a fixed ratio.

3. Printing cylinder supporting unit according to claim 2, in which the movements of the supporting bearings are interconnected by means of straight connecting rods, which are all rigidly connected to each other at the position of a first supporting bearing, and which are each connected in a sliding manner to a separate subsequent supporting bearing.

4. Printing cylinder supporting unit according to claim 2, in which the supporting bearings are each movable along a straight supporting bearing guide.

5. Printing cylinder supporting unit according to claim 2, which comprises three supporting bearings for each axial end of said printing cylinder, in which for each axial end the straight movement line along which a bearing point of a first supporting bearing is moved lies substantially in the plane that is defined by the contact line and the centre point of the common circle, and in which the straight movement lines along which the bearing points of a second and third supporting bearing are moved are mirrored relative to said plane and form an angle of substantially 60° relative to said plane.

6. Printing cylinder supporting unit according to claim 4, in which the supporting bearing guide comprises a groove in the supporting frame, in which a connecting piece is accommodated in a sliding manner, on which connecting piece the supporting bearings are fixed.

7. Printing cylinder supporting unit according to claim 1, in which the supporting bearings are in the form of rollers, which can roll over the bearing surface of the bearing ring.

8. Printing cylinder supporting unit for a printing machine, comprising a supporting frame and a support mounted on the supporting frame for rotatably supporting one of a number of printing cylinders, which are designed so that in the operating state they make contact with a substrate that is to be printed along a contact line coinciding with a describing line of the printing cylinder, wherein unit a printing cylinders can have different diameters and the support for an axial end of the printing cylinder comprises at least three supporting bearings, each of which is designed to interact at a position of a bearing point with a bearing surface of a bearing ring fixed concentrically on the axial end concerned of the printing cylinder, wherein the bearing points for the axial end concerned of the printing cylinder lie on a common circle with variable diameter;

the printing cylinder supporting unit comprises guides for moving the supporting bearings in such a way that the bearing points move along movement lines that have a fixed position relative to the supporting frame, the movement lines intersecting each other at a reference point that is fixed relative to the supporting frame, which reference point lies on the same common circle and in the operating state lies in a plane that is defined by the contact line and the centre point of the common circle;

and the printing cylinder supporting unit comprises a connector for connecting the movements of the bearing points along their respective movement line.

* * * * *